US011154972B2

(12) United States Patent
Lee

(10) Patent No.: US 11,154,972 B2
(45) Date of Patent: Oct. 26, 2021

(54) SWITCH DEVICE FOR NAIL GUN

(71) Applicant: Samson Power Tool Co., Ltd., Taichung (TW)

(72) Inventor: Yi-Kuan Lee, Taichung (TW)

(73) Assignee: Samson Power Tool Co., Ltd., Taichung (TW)

( * ) Notice: Subject to any disclaimer, the term of this patent is extended or adjusted under 35 U.S.C. 154(b) by 98 days.

(21) Appl. No.: 16/750,070

(22) Filed: Jan. 23, 2020

(65) Prior Publication Data

US 2021/0229250 A1 Jul. 29, 2021

(51) Int. Cl.
*B25C 1/00* (2006.01)
*B25C 1/04* (2006.01)

(52) U.S. Cl.
CPC ..... *B25C 1/047* (2013.01); *B25C 1/042* (2013.01); *B25C 1/043* (2013.01)

(58) Field of Classification Search
CPC .. B25C 1/00; B25C 1/008; B25C 1/04; B25C 1/041; B25C 1/042; B25C 1/043; B25C 1/046; B25C 1/047; B25C 1/06; B25C 1/184; B27F 7/34
USPC ..... 227/8, 10, 130, 147; 173/90, 127, 168, 173/169
See application file for complete search history.

(56) References Cited

U.S. PATENT DOCUMENTS 3,088,440 A * 5/1963 Wilmer ..... A22B 3/02 91/5
3,094,900 A * 6/1963 Wandel ..... B25C 1/044 91/423
3,194,324 A * 7/1965 Langas ..... B25C 1/008 173/2
4,384,668 A * 5/1983 Tutomu ..... B25C 1/041 173/169
5,671,880 A * 9/1997 Ronconi ..... B25C 1/042 227/130
6,039,231 A * 3/2000 White ..... B25C 1/04 173/127
7,255,257 B2 * 8/2007 Oouchi ..... B25F 5/00 227/130
7,896,101 B2 * 3/2011 Wakabayashi ..... B25B 21/00 173/169
2007/0119899 A1 * 5/2007 Ronconi ..... B25C 1/043 227/130
2010/0012699 A1 * 1/2010 Liang ..... B25C 1/043 227/8
2010/0038398 A1 * 2/2010 Liang ..... B25C 1/043 227/8

(Continued)

*Primary Examiner* — Hemant Desai
*Assistant Examiner* — Jacob A Smith
(74) *Attorney, Agent, or Firm* — Karin L. Williams; Alan D. Kamrath; Mayer & Williams PC

(57) ABSTRACT

A switch device for a nail gun includes a body having a main chamber and a cylinder is received in the main chamber. A main path communicates with the cylinder. A recess is formed in the body and a valve is received in the recess. An end member is connected to the rear end of the body. An air way communicates between the recess and the end member. A first release path communicates the recess and outside of the body. A communication path communicates between the main chamber and the recess. A switch member is located at the communication path. By operating the switch member, the features of single mode and automatic mode of the nail gun is controlled.

9 Claims, 11 Drawing Sheets

(56) References Cited

U.S. PATENT DOCUMENTS

| | | | | |
|---|---|---|---|---|
| 2012/0061445 | A1* | 3/2012 | Liu | B25C 1/04 227/130 |
| 2014/0202724 | A1* | 7/2014 | Moore | B25C 1/042 173/46 |
| 2019/0022842 | A1* | 1/2019 | Oouchi | B25C 1/047 |
| 2019/0099872 | A1* | 4/2019 | Tanaka | B25C 1/008 |
| 2020/0306940 | A1* | 10/2020 | Theberath | B25C 1/008 |

* cited by examiner

SWITCH DEVICE FOR NAIL GUN

BACKGROUND OF THE INVENTION

1. Fields of the Invention

The present invention relates to a nail gun, and more particularly, to a switch device for switching features of single mode and automatic mode.

2. Descriptions of Related Art

The conventional nail gun generally includes a cylinder in the body of the nail gun, and the piston returns to shoot nails or clips by compressed air. An end member is connected to the rear end of the body of the nail gun so that when the piston moves toward the end member, the end member moves backward to seal a release. Therefore, compressed air is restricted between the piston head and the end member, such that when the trigger is pulled, the compressed air in the cylinder pushes the piston and sends the nail out. The compressed air in the cylinder pushes the piston to shoot the nail, and in the meanwhile the compressed air is released from the front end of the nail gun. A portion of the compressed air flows into the cylinder to push the piston back to its initial position. This action completes a single shot. However, in some cases, the nails are required to shoot continuously to increase the efficiency.

The present invention is intended to provide a switch device for a nail gun, and the users can optionally choose the features of single mode or automatic mode by operating the switching device.

SUMMARY OF THE INVENTION

The present invention relates to a switch device for a nail gun, and comprises a body having a main chamber and a cylinder is received in the main chamber. A main path communicates with the cylinder. A recess is formed in the body and located beside the main path. A valve is received in the recess. An end member is connected to the rear end of the body. An air way communicates between the recess and the end member. A first release path communicates the recess and outside of the body. A communication path communicates between the main chamber and the recess.

The end member has a receiving area in which a movable member is accommodated. A bore is defined through the rear end of the end member. An air path is formed between the recess and the receiving area. The movable member has a first groove defined in the outside thereof A seal is engaged with the first groove. A passage is defined axially through the movable member. A spring is biased between the movable member and the inside of the end member. A piston includes a piston head and a strike member extending from the piston head. The piston head is movably located in the cylinder, and the strike member extends through the cylinder. The piston head includes a second groove in which another seal is engaged. The valve includes a ring, an inside part and an outside part respectively located in the recess. A first movable part is movably located between the ring and a room in the inside part. A second movable member has a first end thereof located in a first axial hole of the first movable part. A second end of the second movable member is movably located between the ring and the outside member. An axle has the first end thereof located in a second axial hole of the second movable member. A second end of the axle movably protrudes beyond a central hole of the outside member.

The inside part 50 has a third groove 500 defined in the outside thereof. Another seal is engaged with the third groove. A room is defied in the inside part and the first movable part is movably located in the room. A first radial hole and a second radial hole are respectively defined radially through the wall of the inside part. The first radial hole communicates with the air way. The second radial hole communicates with the first release path. The first movable part includes a first outer groove and another seal is engaged with the first outer groove. The ring includes through hole, and an inner groove is defined in the inner periphery of the through hoe. Another seal is engaged with the inner groove. The ring includes a second outer groove defined in the outside thereof. Another seal is engaged with the second outer groove. The second movable part includes a third outer groove defined in the outside thereof. Another seal is engaged with the third outer groove. A third radial hole and a fourth hole are respectively defined radially through the wall of the second movable part. Air enters into and leaves from a first space that is formed between the first movable part and the ring via the third radial hole. Air enters into and leaves from a second space that is formed between the second movable part and the ring via the fourth radial hole. The axle has a fourth groove defined in the outside thereof and another seal is engaged with the fourth groove. A contact portion extends from the second end of the axle that movably protrudes beyond the central hole of the outside member. The outside member includes an engaging groove defined in an outside thereof and another seal is engaged with the engaging groove. A reception area is defined in the outside member and the second movable part is partially located in the reception area. A fifth radial hole is defined radially through the wall of the outside member and communicates with the reception area. The fifth radial hole communicates with the communication path. A switch member includes a first annular groove and a second annular groove defined in the outside thereof. Another seal is engaged with the first annular groove. A clip is engaged with the second annular groove. The valve controls the movable member to move to switch the nail gun between features of single mode and automatic mode.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
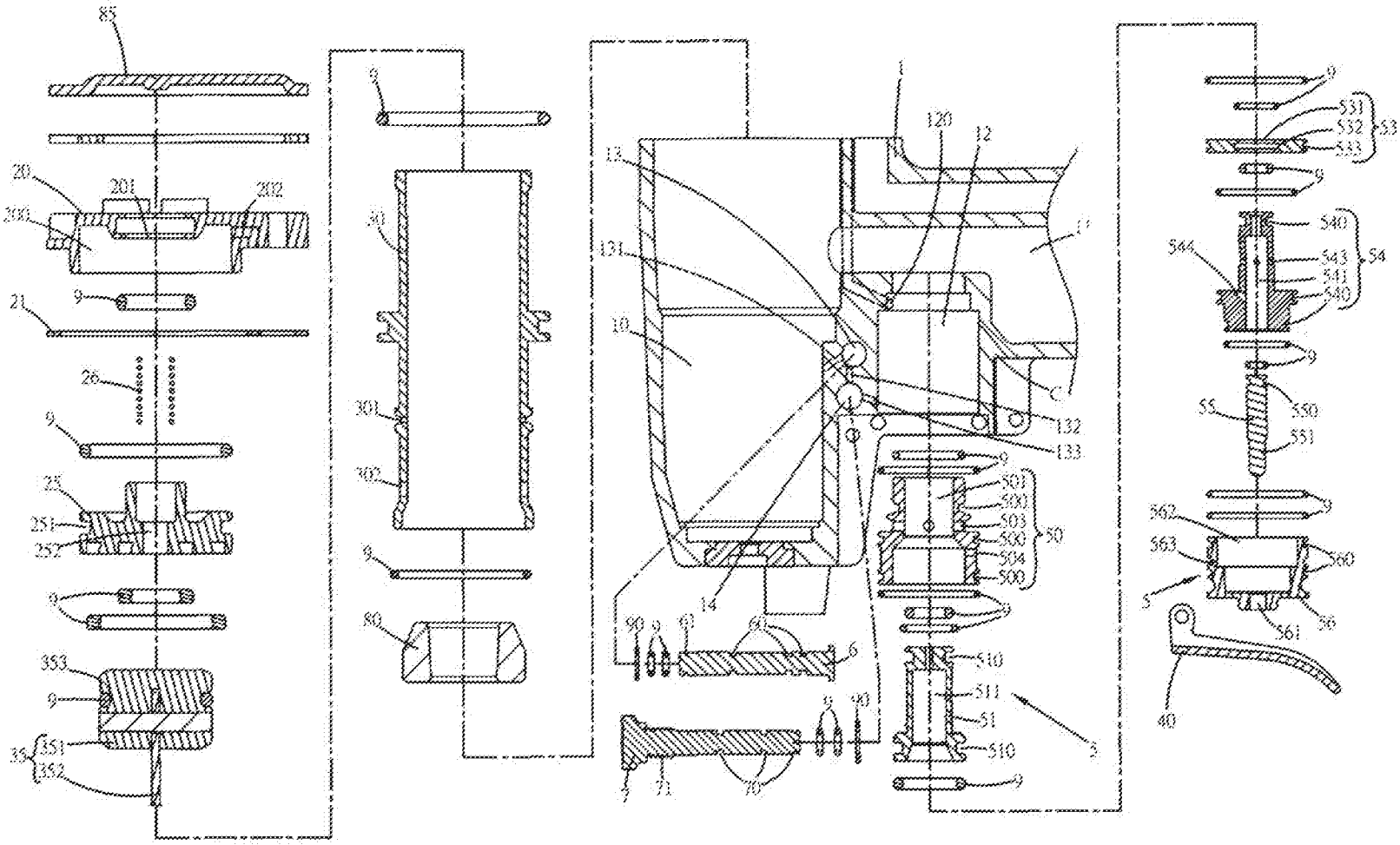
FIG. 1 is an exploded and cross sectional showing the switch device of nail gun of the present invention.

Referring to FIGS. 1 to 12, the nail gun of the present invention comprises a body 1 having a main chamber 10, a cylinder 30 received in the main chamber 10, a recess, an air way 120, a first release path "C" and a communication path "B". The main chamber 10 is defined to include a first chamber 100 and a second chamber 101. The second chamber 101 communicates with the second area 122 via the communication path "B". A ring 53 of the valve 5 defines the recess 12 into a first area 121 and a second area 122. The air way 120 communicates the first area 121 with the end member 20. The first release path "C" communicates with the first area 121 with the outside of the body 10. The first release path "C" allows the air located behind the movable member 25 to be released to outside of the nail gun. A first compartment 13 and a second compartment 14 are respectively defined between the recess 12 and the main chamber 10. The first and second compartments 13, 14 respectively accommodate the switch member 6 and the adjustment member 7 received therein. The first aperture 131 and the second aperture 132 respectively communicate with the second chamber 101 and the second compartment 14. The second compartment 14 communicates with the second area 122 via the third aperture 133. The first aperture 131, the first compartment 13, the second aperture 132 and the third aperture 133 (or the first aperture 131, the first compartment 13, the second aperture 132, the second compartment 14 and the third aperture 13) define the communication path "B". By operating the switch member 6, the communication between the main chamber 10 with the recess 12 via the communication path "B" is controlled.

The end member 20 is connected to the rear end of the body 1, and an urging plate 21 is located between the body 1 and the end member 20. The end member 20 having a receiving area 200 in which a movable member 25 is accommodated. A bore 201 is defined through the rear end of the end member 20. The end member 20 includes a lateral hole 202 that communicates with the receiving area 200. An air path "A" is formed between the lateral hole 202 and the air way 120. Air enters into and leaves from an area between the movable member 25 and the receiving are 200 via the air path "A".

The movable member 25 is connected between the receiving area 200 and the cylinder 30. The movable member 25 has a first groove 251 defined in the outside thereof. A seal 9 is engaged with the first groove 251. A passage 252 is defined axially through the movable member 25. A spring 26 is biased between the movable member 25 and the inside of the end member 20.

The cylinder 30 includes the piston 35 movably received therein. The cylinder 30 includes a first hole 301 and a second hole 302 to respectively communicate with the second chamber 101. A seal 9 is mounted to the cylinder 30 and engaged with the first hole 301 so that when the piston head 351 moves, air in the cylinder 30 is pushed into the second chamber 101 and stored in the second chamber 101. In the same time, when the piston head 351 moves to one end of the cylinder 30 and contacts the pad 80, the pressurized air that flows into the cylinder 30 pushes the seal 9 corresponding to the first hole 301 outward and enters into the second chamber 101.

Specifically, the piston 35 includes the piston head 351 and a strike member 352 that extends from the piston head 351. The piston head 352 is movably located in the cylinder 30 and the strike member 352 extends through the cylinder 30. The piston head 352 includes a second groove 353 in which another seal 9 is engaged.

The valve 5 is located in the recess 12. A ring 53, an inside part 50 located in the first area 121 and an outside part 56 located in the second area 122 are respectively located in the recess 12. A first movable part 51 is movably located between the ring 53 and a room 501 in the inside part 50. A second movable member 54 has the first end thereof located in the first movable part 51. The second end of the second movable member 54 is movably located between the ring 53 and the outside member 56. An axle 55 has the first end thereof located in a second axial hole 541 of the second movable member 54. The second end of the axle 55 movably protrudes beyond a central hole 561 of the outside member 56. The inside part 50 has a third groove 500 defined in the outside thereof, and another seal 9 is engaged with the third groove 500. A room 501 is defined in the inside part 50 and the first movable part 51 is movably located in the room 501. A first radial hole 503 and a second radial hole 504 are respectively defined radially through the wall of the inside part 50. The first radial hole 503 communicates with the air way 120, and the second radial hole 504 communicates with the first release path "C". The first movable part 51 includes a first outer groove 510 and another seal 9 is engaged with the first outer groove 510. The first movable part 51 includes a first axial hole 511 so as to accommodate the first end of the second movable part 54. The ring 53 includes through hole 531. An inner groove 532 is defined in the inner periphery of the through hoe 531. Another seal 9 is engaged with the inner groove 532. The ring 53 further includes a second outer groove 533 defined in the outside thereof, and another seal 9 is engaged with the second outer groove 533. The second movable part 54 includes a third outer groove 540 defined in the outside thereof, and another seal 9 is engaged with the third outer groove 540. A third radial hole 543 and a fourth hole 544 are respectively defined radially through the wall of the second movable part 54. Air enters into and leaves from a first space "D" that is formed between the first movable part 51 and the ring 53 via the third radial hole 543. Air enters into and leaves from a second space "E" that is formed between the second movable part 54 and the ring 53 via the fourth radial hole 544. The axle 55 has a fourth groove 550 defined in an outside thereof and another seal 9 is engaged with the fourth groove 550. A contact portion 551 extends from the second end of the axle 55 that movably protrudes beyond the central hole 561 of the outside member 56. The outside member 56 includes two engaging grooves 560 defined in the outside thereof and two respective seal 9 are engaged with the engaging grooves 560. A reception area 562 is defined in the outside member 56 and the second movable part 54 is partially located in the reception area 562. A fifth radial hole 563 is defined radially through the wall of the outside member 56 and communicates with the reception area 562. The fifth radial hole 563 is located between the two engaging grooves 560 and communicates with the third aperture 133 or the communication path "B" such that air is allowed to enter into the third space "F".

The switch member 6 movably located in the first compartment 13 and includes a first annular groove 60 and a second annular groove 61 defined in the outside thereof. Another seal 9 is engaged with the first annular groove 60, and a clip 90 is engaged with the second annular groove 61.

The adjustment member 7 is rotatably located in the second compartment 14 to control air volume that enters into the cylinder 30. The adjustment member 7 includes a receiving groove 70 defined in the outside thereof and another seal 9 is engaged with the receiving groove 70. The adjustment member 7 includes a threaded section 71 which is threadedly connected to the second compartment 14. A restriction groove 72 is defined in the outside of the adjustment member 7 and a clip 90 is engaged with the restriction groove 72.

Figure 2:
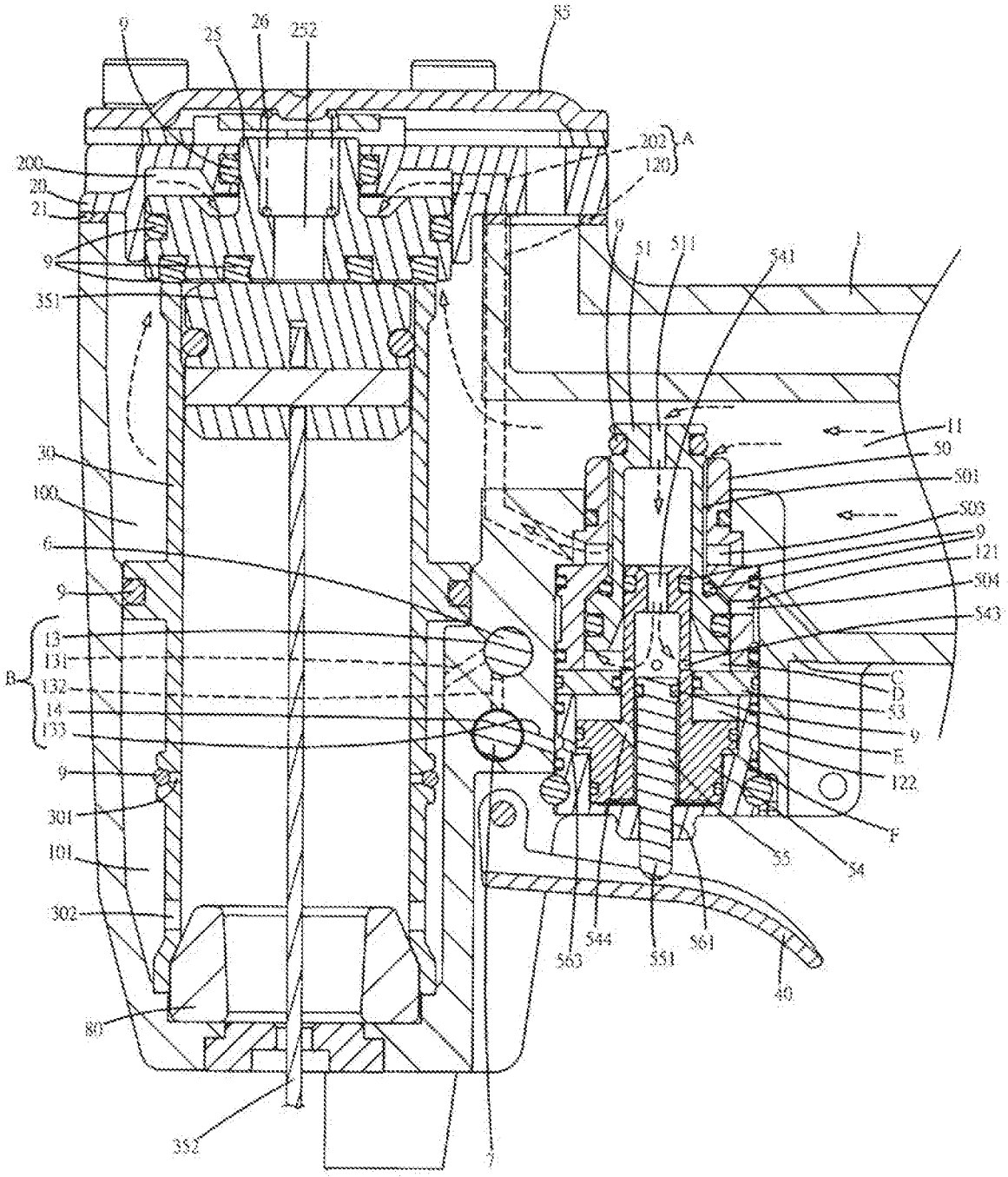
FIG. 2 is a cross sectional showing the switch device of nail gun of the present invention.

When compressed air is intruded into the main path 11, the pressurized air flows through the first axial hole 511 of the first movable part 51, and then flows through the second axial hole 541 and the third radial hole 543 of the second movable part 54, and fills the first space "D" between the first movable part 51 and the ring 53. Because the area on one end of the first movable part 51 is larger than the area on the other end of first movable part 51, so that the first movable part 51 moves until the seal 9 at the middle section of the first movable part 51 contacts the inclined wall of the room 501 of the inside part 50. The seal 9 in the first outer groove 510 does not block the room 501 of the inside part 50. In other words, there is a gap between the first movable part 51 and the room 501, and the gap communicates with the first radial hole 503 and the air way 120 (the air path "A"). Therefore, the compressed air flows through the air path "A" via the gap and to the movable member 25, and the pressurized air together with the spring 26 to push the movable member 25 to contact the cylinder 30 as shown in FIG. 2 to form a ready-to-shoot status.

Figure 3:
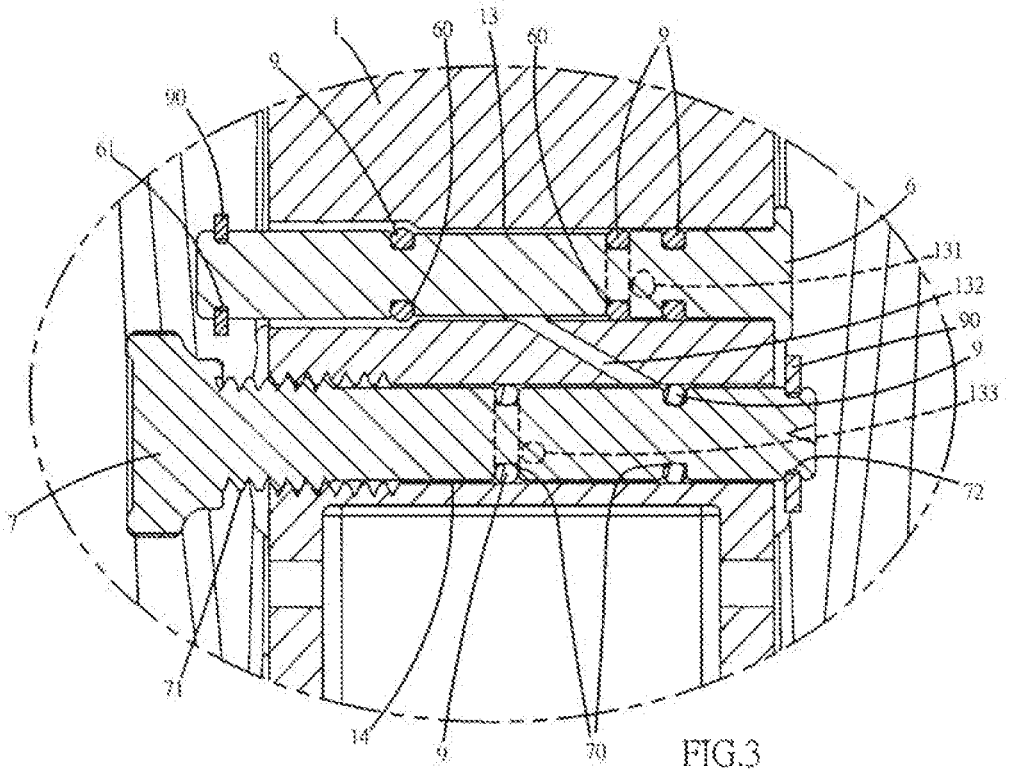
FIG. 3 is a cross sectional view to show one status of the switch member of the switch device of nail gun of the present invention.
Figure 6:
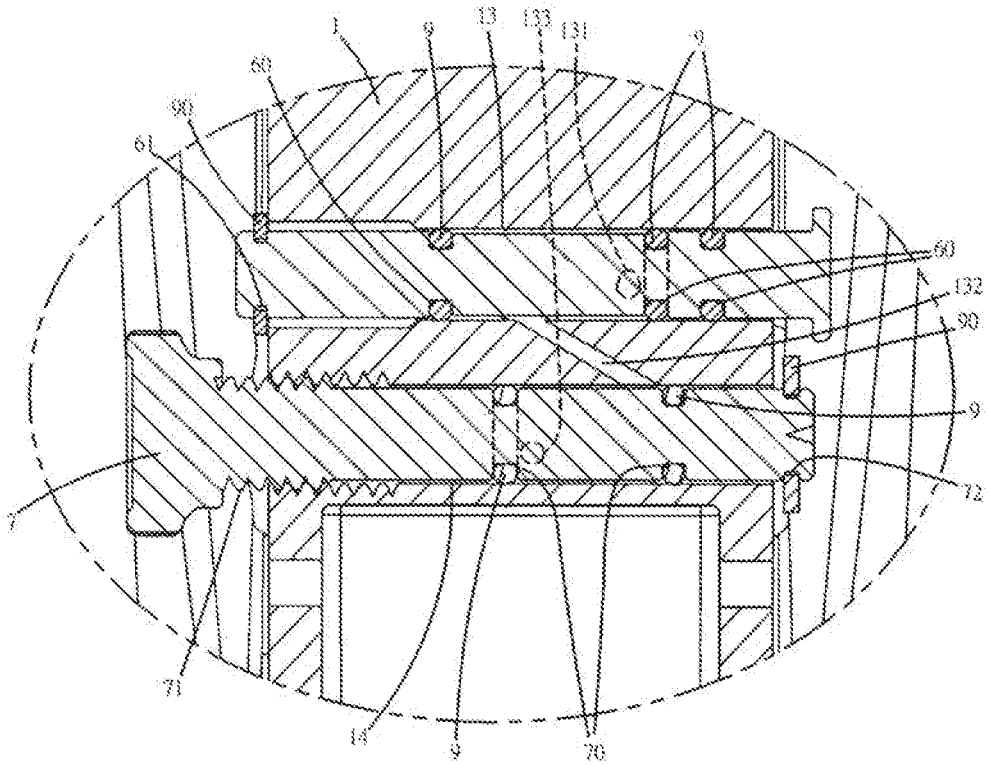
FIG. 6 is a cross sectional view to show that the switch member is operated to switch the nail gun to the feature of automatic mode.
Figure 4:
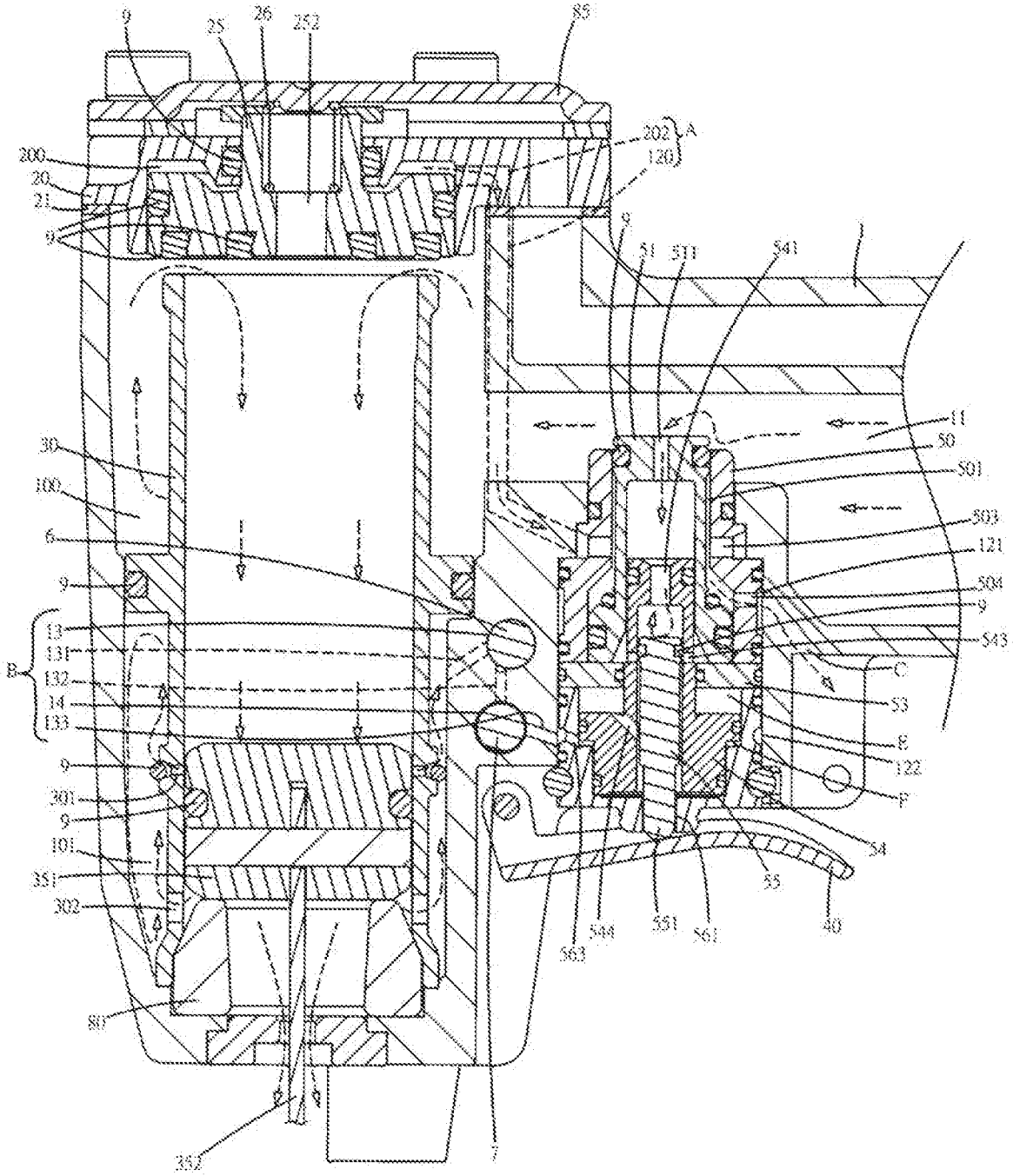
FIG. 4 is a cross sectional view to show that the trigger is pulled.

Before shooting, the switch member 6 is pushed to let the seal 9 at the middle section of the switch member 6 and the seal 9 at the right end (FIG. 1) are respectively located on two sides of the first aperture 131 to communicate the first aperture 131 with the first compartment 13, while the first compartment 13 does not communicate with the second aperture 132 as shown in FIG. 3. The trigger 40 is then pulled to push the axle 55 along the second axial hole 541 of the second movable part 54 until the seal 9 at the fourth groove 550 moves over the third radial hole 543 to stop the pressurized air from the first space "D" between the first movable part 51 and the ring 53. Because the third radial hole 543 communicates with the gap between the outside of the axle 55 and the second axial hole 541, so that the pressurized air in the space "D" passes through the third radial hole 543 and the gap, and is released from the central hole 561 of the outside part 56. Therefore, the first movable part 51 is applied by the compressed air from the main path 11 and moves until the seal 9 of the first movable part 51 completely blocks the room 501 of the inside part 50, and the seal 9 at the middle section of the first movable part 51 does not contact the inclined wall of the room 501. The first radial hole 503, the room 501, the second radial hole 504, the air path "A" and the first release path "C" is in communication with each other so that the compressed air behind the movable member 25 releases to outside of the nail gun via the air path "A", first radial hole 503, the room 501, the second radial hole 504 and the first release path "C". Therefore, the force of the compressed air in the main path 11 is larger than that of the spring 26 so that the movable member 25 is pushed until the movable member 25 is completely separated from the cylinder 30, and the compressed air suddenly fills the cylinder 30 and pushes the piston 35 to hit the pad 80 to complete the shooting action. The compressed air pushes the seal 9 from the first hole 301 and then flows into the second chamber 101 and is stored in the second chamber 101. The compressed air then flows into the first compartment 13 via the first aperture 131. The two seals 9 of the first annular grooves 60 of the switch member 6 are able to move the two sides of the first aperture 131 to stop the compressed air in the first compartment 13 from entering into the second compartment 14 as shown in FIG. 4.

Figure 5:
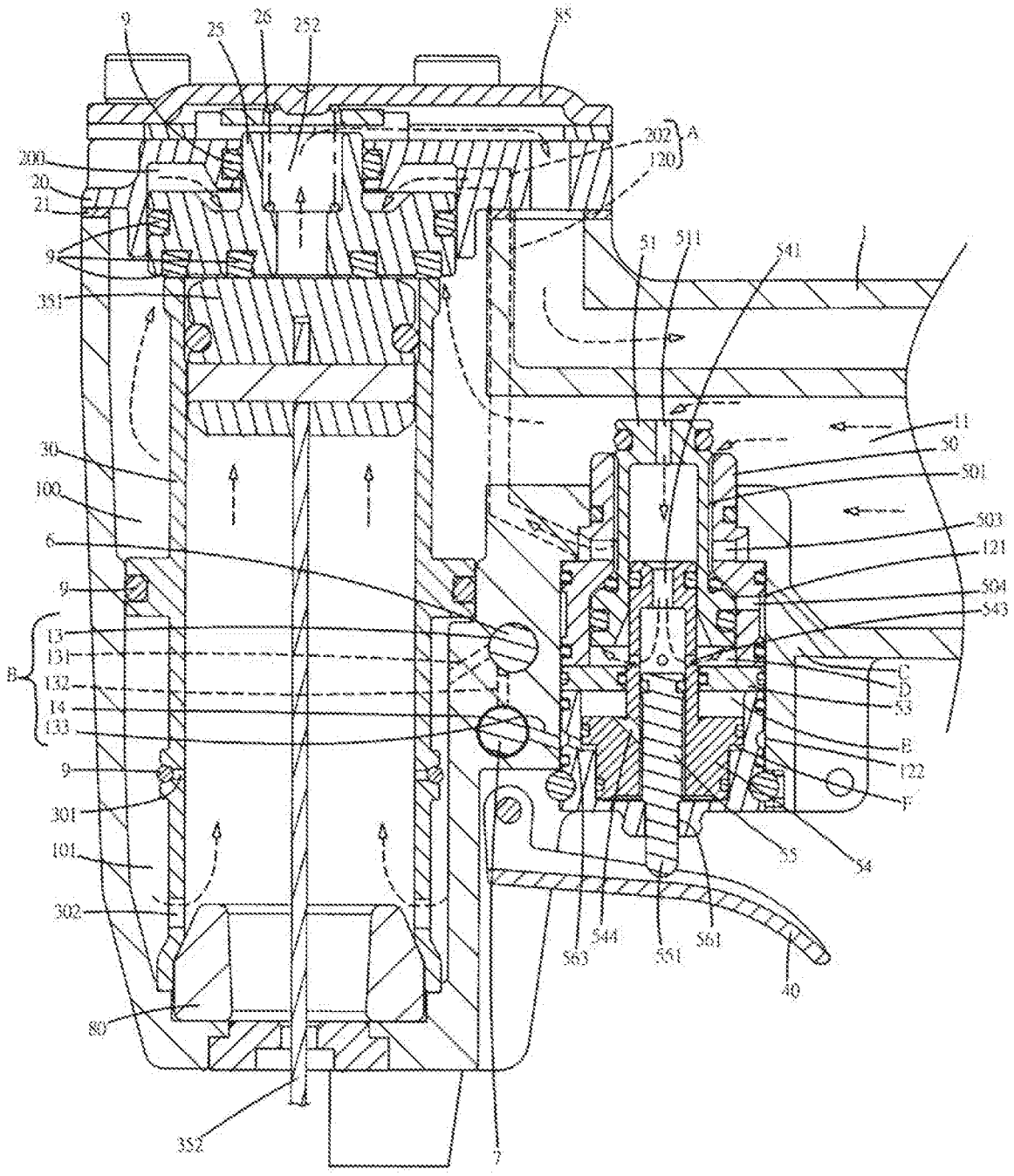
FIG. 5 is a cross sectional view to show that the trigger is not pulled.

When the trigger 40 is released, the compressed air pushes the axle 55 to its initial position, and the third radial hole 543 communicates with the second axial hole 541 and the main path 11, so that the compressed air quickly pushes the first movable part 51 until the seal 9 at the middle section of the first movable part 51 contacts the inclined wall of the room 501 of the inside part 50. Therefore, the sea 9 of the first movable part 51 located close to one end thereof does not block the room 501, and there is a gap formed between the first movable part 51 and the room 501, and the gap communicates with the air path "A". The compressed air flows through the gap and the air path "A", and together with the spring 26 to push the movable member 25 to contact the cylinder 30. A gap is formed between the movable member 25 and the cap 85, so that the compressed air behind the movable member 25 releases from the gap. The compressed air stored in the second chamber 101 flows into the cylinder 30 via the second hole 302 to push the piston 35 back to its initial position as shown in FIG. 5 to complete the action of single mode.

When the users want to use the feature of automatic mode, the switch member 6 is pushed to the right viewed from the drawings, the seal 9 at the middle section of the switch member 6 is removed from the left side of first aperture 131 to the right side of the first aperture 131 of the drawings, so that the first aperture 131, the first compartment 13, the second aperture 132, the second compartment 14 and the third aperture 133 (the communication path "B") are in communication with each other. When the trigger 40 is pulled, the piston 35 moves as described before.

Figure 7:
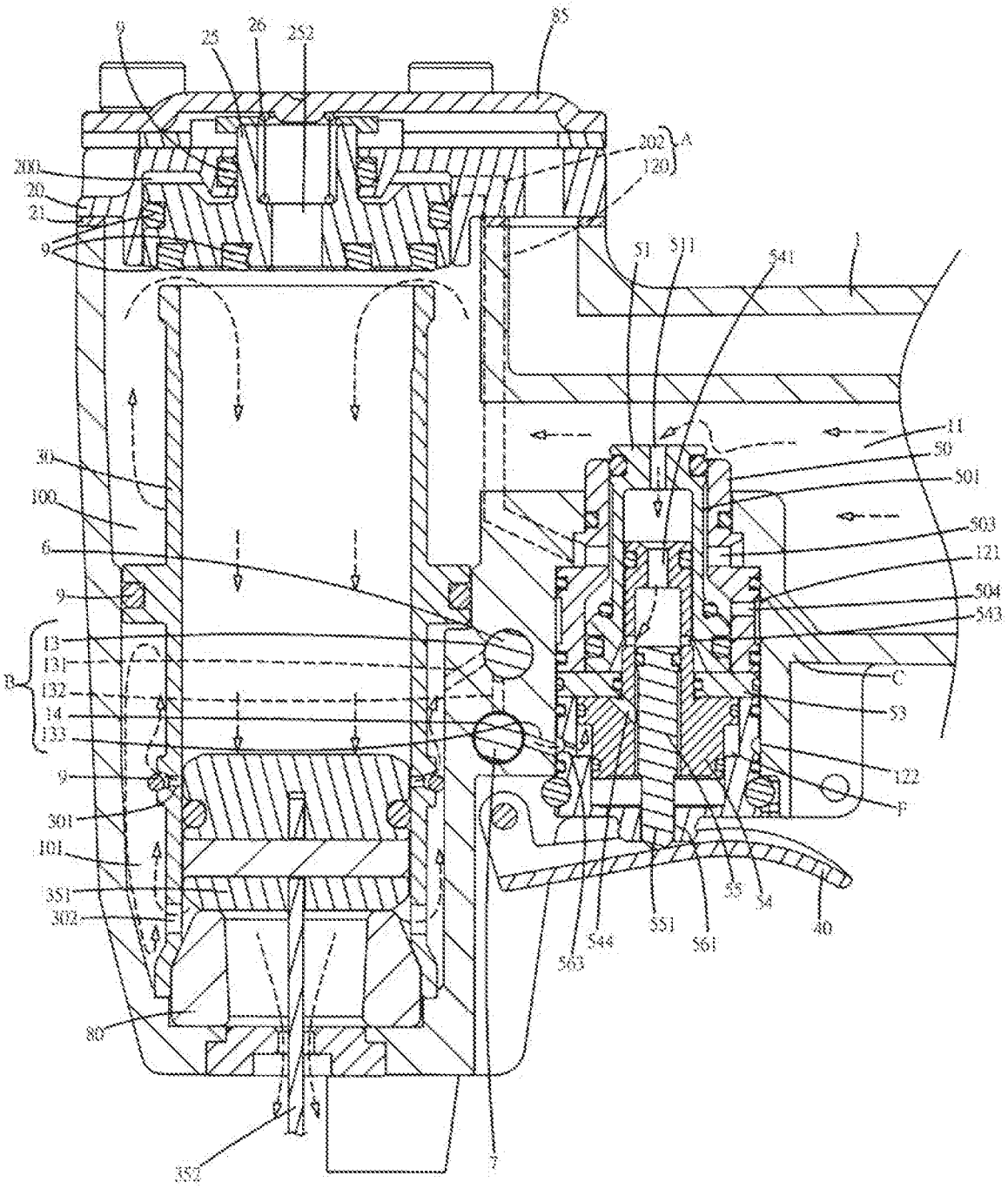
FIG. 7 is a cross sectional view to show the nail gun of the present invention at the status as disclosed in FIG. 6.
Figure 8:
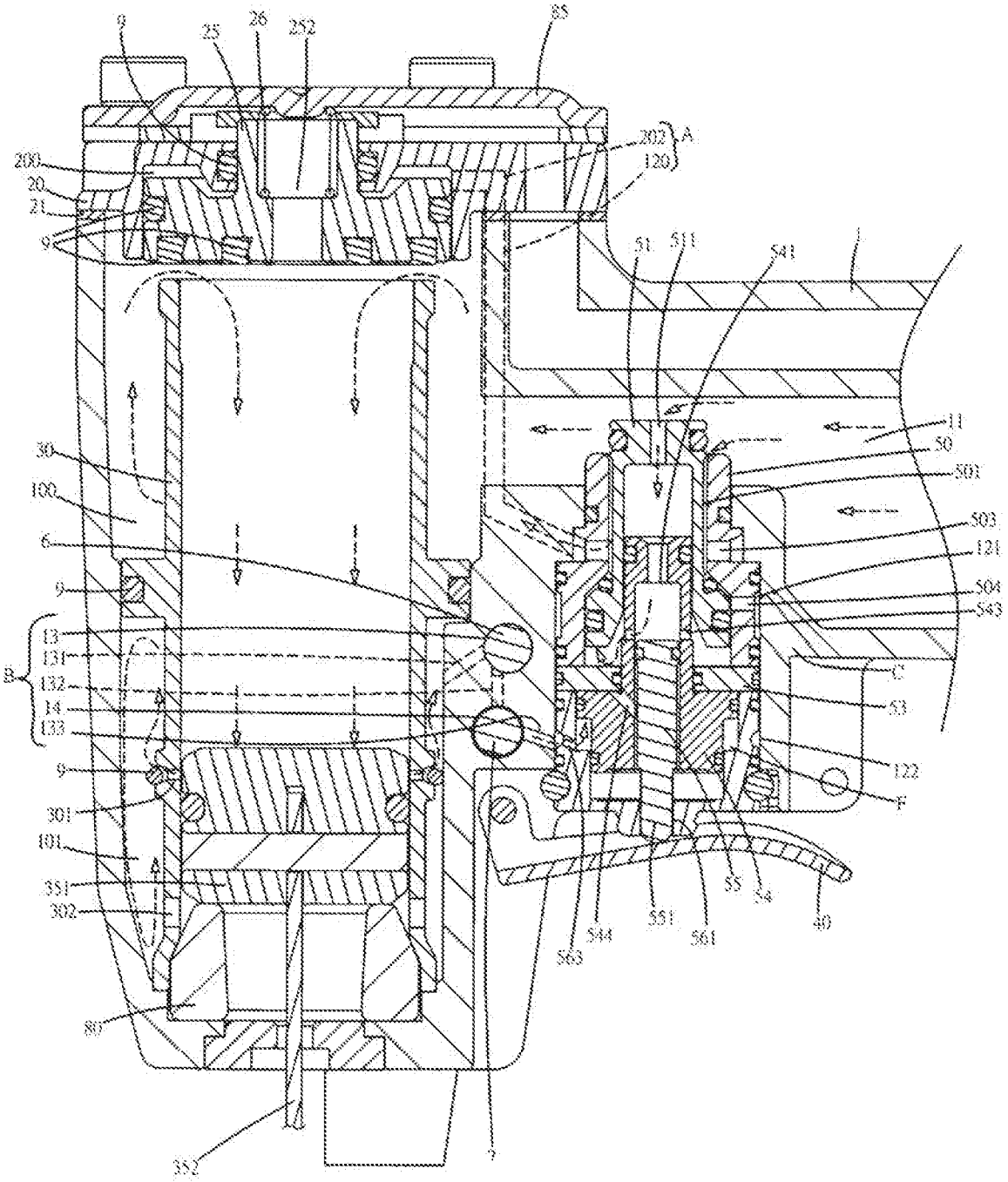
FIG. 8 shows a status following the status as disclosed in FIG. 7.
Figure 9:
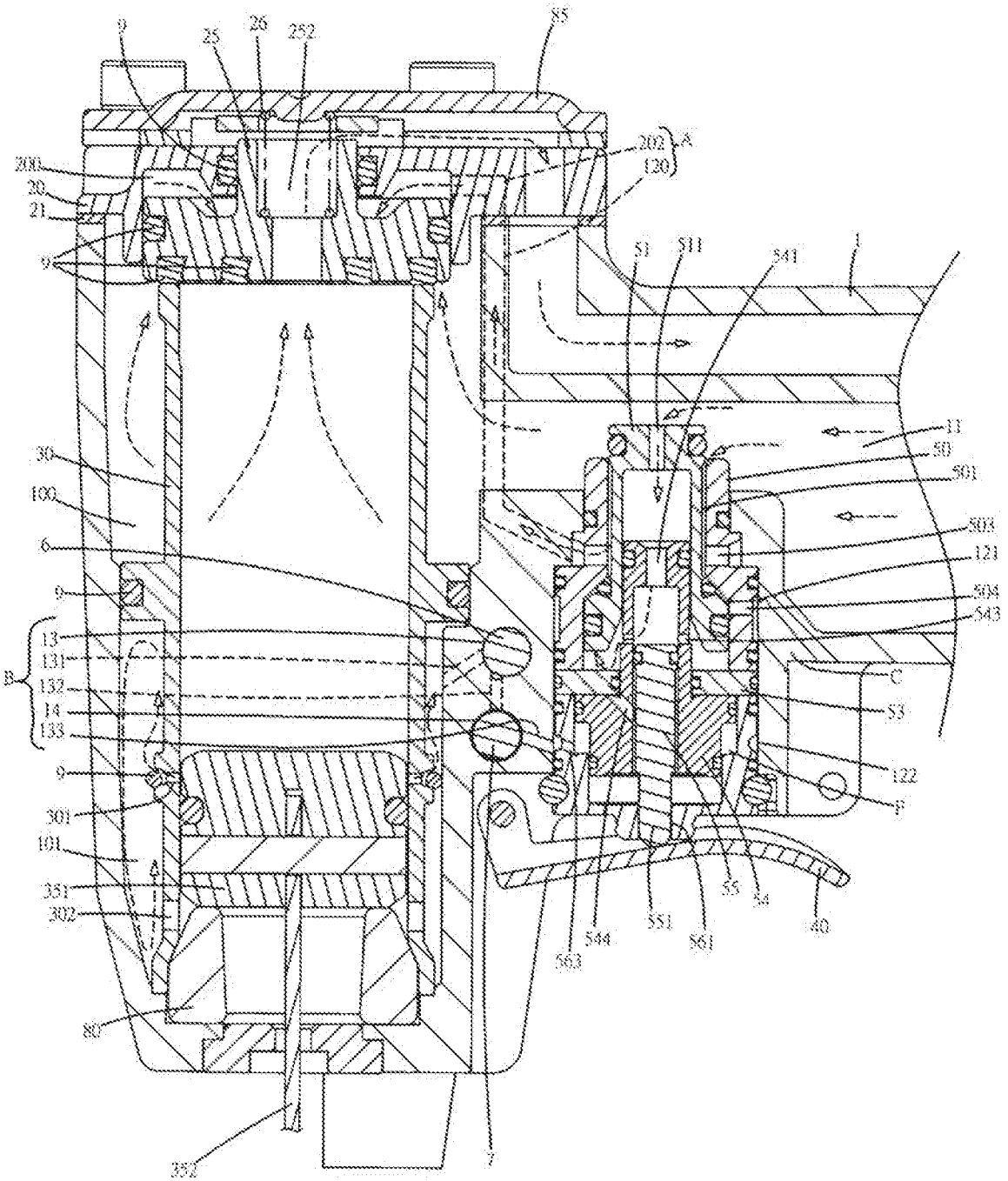
FIG. 9 shows a status following the status as disclosed in FIG. 8.
Figure 10:
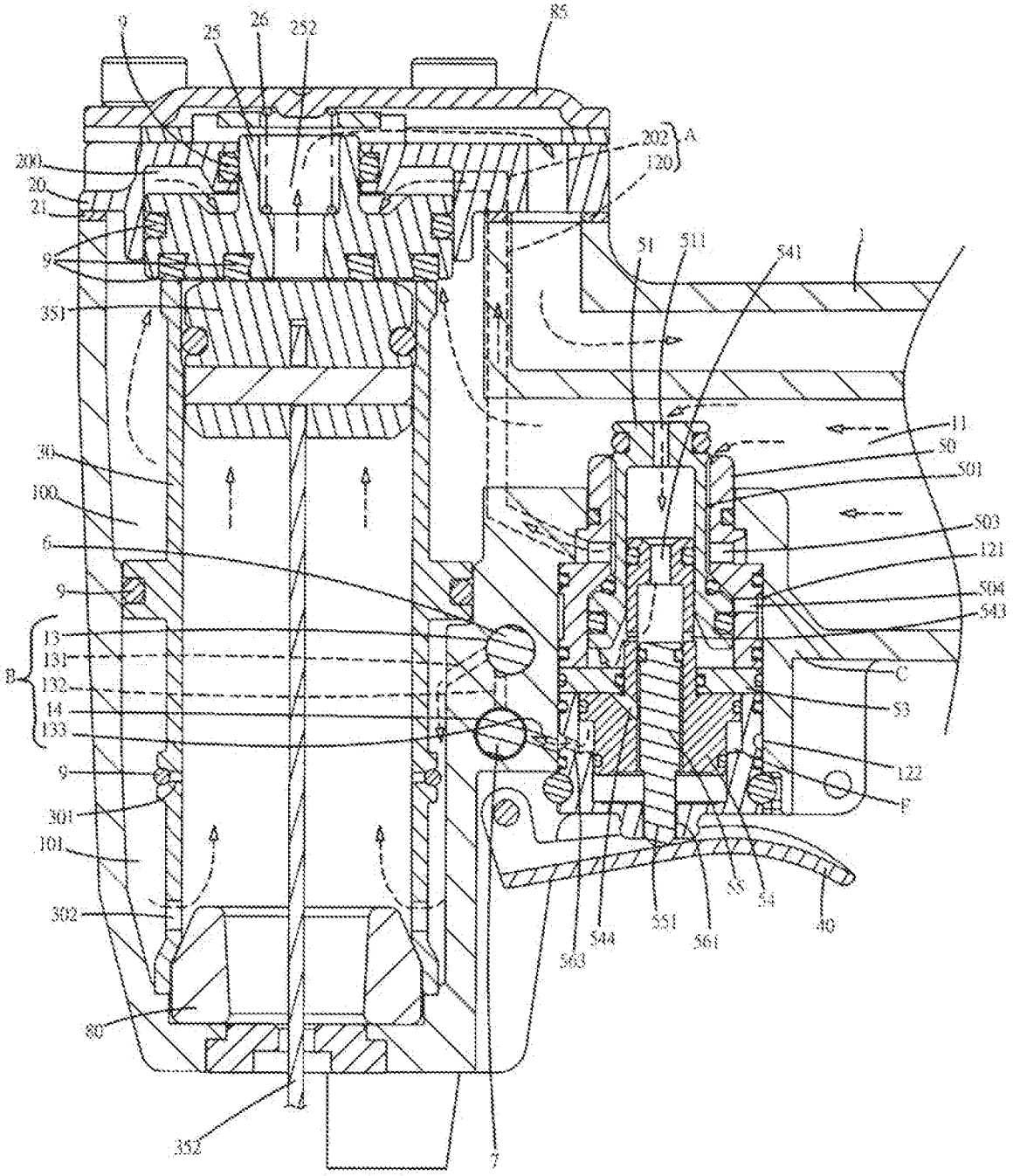
FIG. 10 shows a status following the status as disclosed in FIG. 9.
Figure 11:
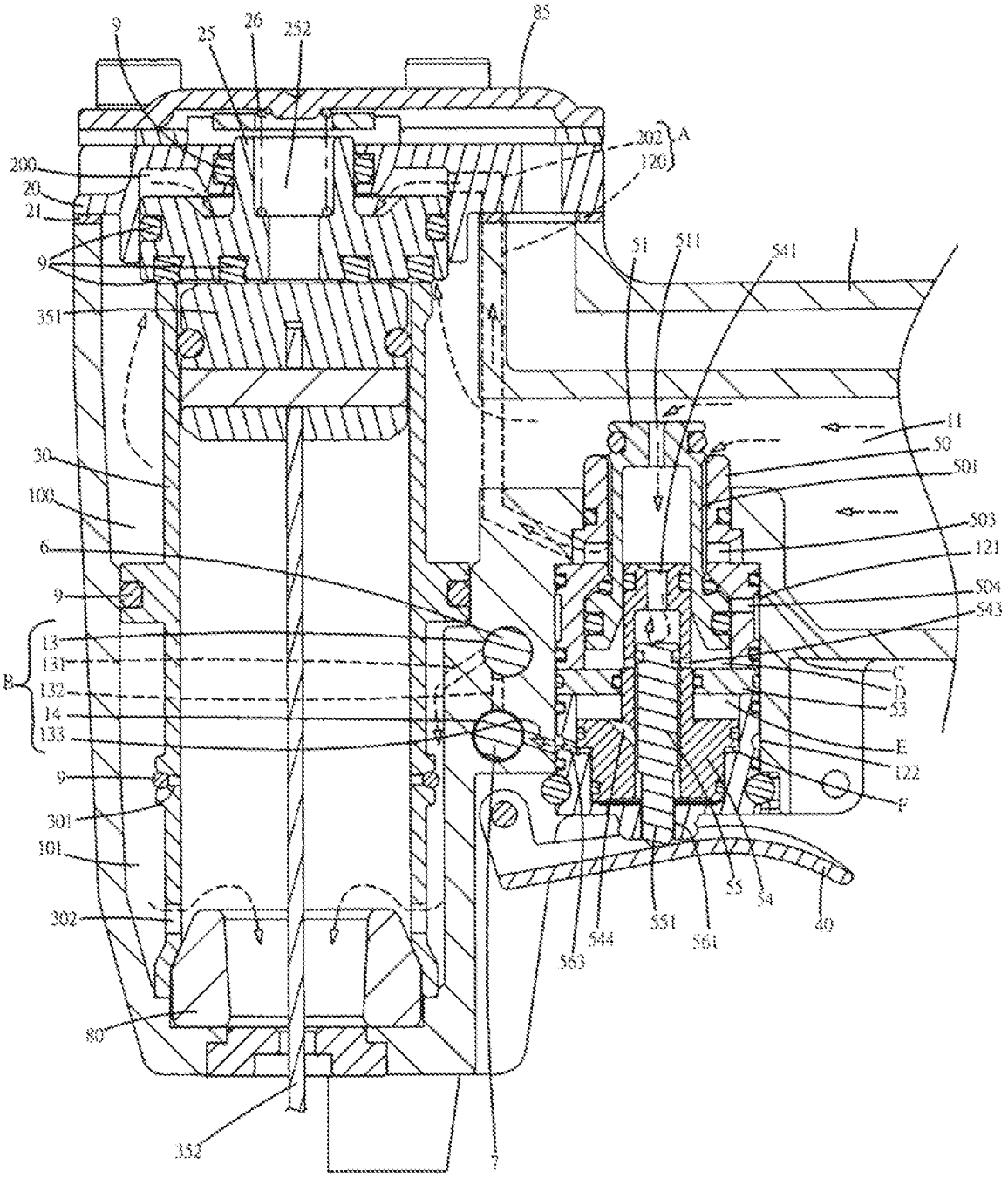
FIG. 11 shows a status following the status as disclosed in FIG. 10.

When the piston 35 hits the pad 80, the compressed air in the cylinder 30 pushes the seal 9 outward from the first hole 301, and then flows into the second chamber 101 and is stored in the second chamber 101. The second movable part 54 is then pushed by the compressed air via the communication path "B", the fifth radial hole 563 of the outside part 56, the second space "F", until the third radial hole 543 moves over the seal 9 on the axle 55. The third radial hole 543 communicates with the second axial hole 541. Such that the compressed air in the main path 11 flows into the position beneath (FIG. 7) the first movable part 51 via the first axial hole 511, the second axial hole 541 and the third radial hole 543. The areas of the two ends of the first movable part 51 are different so that the first movable part 51 is pushed until the seal 9 at the middle section of the first movable part 51 contacts the inclined wall of the room 501. The seal 9 located close to one end of the first movable part 51 does not block the room 501, and a gap is formed between the first movable part 51 and the room 501. The gap communicates with the air path "A" as shown in FIG. 8, the compressed air flows through the gap and the air path "a", and then applies a force together with the spring 26 to push the movable member 25 to contact the cylinder 30 as shown in FIG. 9. There is a gap formed between the cap 85 and the movable member 25 to allow the compressed air behind the movable member 25 to release. The compressed air in the communication path "B" and the second chamber 101 flows into the cylinder 30 via the second hole 302 to push the piston 35 to its initial positon as shown in FIG. 10. Because the compressed air in the communication path "B" is released so that compressed air in the main path 11 applies a force to the second movable part 54 and pushes the second movable part 54 until the third radial hole 543 of the second movable part 54 moves to a position beneath the seal 9 on the axle 55 as shown in FIG. 11 to stop the compressed air from entering the first space "D". Because the third radial hole 543 communicates with the gap between the axle 55 and the second axial hole 541, the compressed air in the first space "D" releases to outside from the third radial hole 543, the gap and the central hole 561 of the outside part 56. The first movable part 51 is then pushed downward as shown in FIG. 7. The reciprocated actions allows the nail gun to continuously shoot by one-time pulling the trigger 40.

Figure 12:
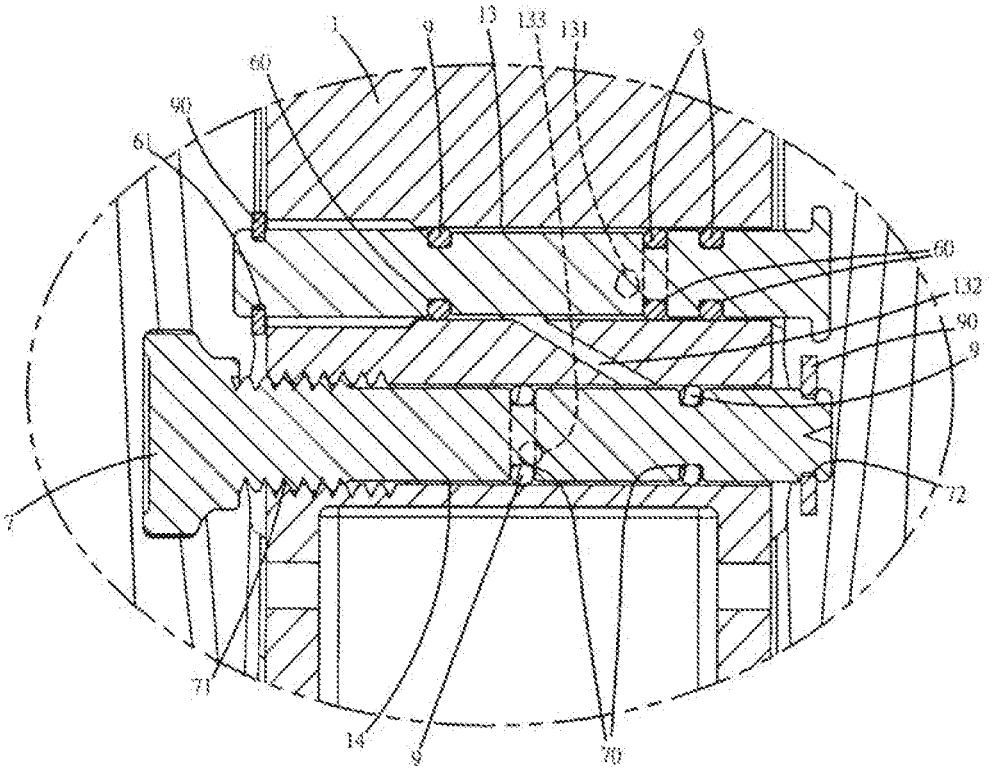
FIG. 12 shows that the adjustment member is rotated.

As shown in FIG. 12, when the adjustment member 7 is threadedly moves toward right as shown in FIG. 12, the seal 9 at the middle section 9 located close to the threaded section 71) of the adjustment member 7 partially blocks the third aperture 133 to narrow the opening area of the third aperture 133 so that the volume and the speed of the compressed air is adjusted and controlled to adjust the shooting speed of the nails under the automatic mode.

While we have shown and described the embodiment in accordance with the present invention, it should be clear to those skilled in the art that further embodiments may be made without departing from the scope of the present invention.

What is claimed is:

1. A switch device for a nail gun, comprising:

a body (1) having a main chamber (10), a cylinder (30) received in the main chamber (10), a main path (11) communicating with the cylinder (30), a recess (12) formed in the body (1) and located beside the main path (11), a valve (5) received in the recess (12), an end member (20) connected to a rear end of the body (1), an air way (120) communicating between the recess (12) and the end member (20), a first release path (C) communicating the recess (12) and outside of the body (1), a communication path (B) communicating between the main chamber (10) and the recess (12);

the end member (20) having a receiving area (200) in which a movable member (25) is accommodated, a bore (201) defined through a rear end of the end member (20), an air path (A) formed between the recess (12) and the receiving area (200);

the movable member (25) having a first groove (251) defined in an outside thereof, a seal (9) engaged with the first groove (251), a passage (252) defined axially through the movable member (25), a spring (26) biased between the movable member (25) and an inside of the end member (20);

a piston including a piston head (351) and a strike member (352) extending from the piston head (351), the piston head (352) movably located in the cylinder (30) and the strike member (352) extending through the cylinder (30), the piston head (351) including a second groove (353) in which another seal (9) is engaged;

the valve (5) including a ring (53), an inside part (50) and an outside part (56) respectively located in the recess (12), a first movable part (51) movably located between the ring (53) and a room (501) in the inside part (50), a second movable member (54) having a first end thereof located in a first axial hole (511) of the first movable part (51), a second end of the second movable member (54) movably located between the ring (53) and the outside member (56), an axle (55) having a first end thereof located in a second axial hole (541) of the second movable member (54), a second end of the axle (55) movably protruding beyond a central hole (561) of the outside member (56), wherein the inside part (50) has a third groove (500) defined in an outside thereof, another seal (9) is engaged with the third groove (500), the first movable part (51) is movably located in the room (501), a first radial hole (503) and a second radial hole (504) are respectively defined radially through a wall of the inside part (50), the first radial hole (503) communicating with the air way (120), the second radial hole (504) communicating with the first release path (C), the first movable part (51) includes a first outer groove (510) and another seal (9) is engaged with the first outer groove (510), the ring (53) includes through hole (531), an inner groove (532) is defined in an inner periphery of the through hole (531), another seal (9) is engaged with the inner groove (532), the ring (53) includes a second outer groove (533) defined in an outside thereof, another seal (9) is engaged with the second outer groove (533), the second movable part (54) includes a third outer groove (540) defined in an outside thereof, another seal (9) is engaged with the third outer groove (540), a third radial hole (543) and a fourth hole (544) are respectively defined radially through a wall of the second movable part (54), air enters into and leaves from a first space (D) that is formed between the first movable part (51) and the ring (53) via the third radial hole (543), air enters into and leaves from a second space (E) that is formed between the second movable part (54) and the ring (53) via the fourth radial hole (544), the axle (55) has a fourth groove (550) defined in an outside thereof and another seal (9) is engaged with the fourth groove (550), a contact portion (551) extends from the second end of the axle (55) that movably protrudes beyond the central hole (561) of the outside member (56), the outside member (56) includes an engaging groove (560) defined in an outside thereof and another seal is engaged with the engaging groove (560), a reception area (562) is defined in the outside member (56) and the second movable part (54) is partially located in the reception area (562), a fifth radial hole (563) is defined radially through a wall of the outside member (56) and communicates with the reception area (562), the fifth radial hole (563) communicates with the communication path (B), a switch member (6) includes a first annular groove (60) and a second annular groove (61) defined in an outside thereof, another seal (9) is engaged with the first annular groove (60), a clip (90) is engaged with the second annular groove (61), the valve (5) controls the movable member (25) to move to switch the nail gun between features of single mode and automatic mode.

2. The switch device for a nail gun as claimed in claim 1, wherein the communication path (B) includes a first aperture (131) that communicates with the main chamber (10), a first compartment (13) that communicates with the first aperture (131), a second aperture (132) that communicates between the first compartment (13) and the recess (12).

3. The switch device for a nail gun as claimed in claim 1, wherein the communication path (B) includes a first aperture (131) that communicates with the main chamber (10), a first compartment (13) that communicates with the first aperture (131), a second aperture (132) that communicates with the first compartment (13), a second compartment (14) that communicates with the second aperture (132), a third aperture (133) that communicates between the second compartment (14) and the recess (12).

4. The switch device for a nail gun as claimed in claim 2, wherein the switch member (6) is located at the communication path (B) between the recess (12) and the main chamber (10), the switch member (6) is movable in the first compartment (13) so as to control communication between the communication path (B) to the recess (12) and the main chamber (10).

5. The switch device for a nail gun as claimed in claim 4, wherein the end member (20) includes a lateral hole (202) that communicates with the receiving area (200), the air path (A) is formed between the lateral hole (202) and the air way (120), air enters into and leaves from an area between the movable member (25) and the receiving are (200) via the air path (A).

6. The switch device for a nail gun as claimed in claim 5, wherein the communication path (B) includes a second compartment (14), an adjustment member (7) is rotatably located in the second compartment (14) to control air volume that enters into the cylinder (30).

7. The switch device for a nail gun as claimed in claim 6, wherein the adjustment member (7) includes a receiving groove (70) defined in an outside thereof and another seal (9) is engaged with the receiving groove (70), the adjustment member (7) includes a threaded section (71) which is threadedly connected to the second compartment (14), a restriction groove (72) is defined in the outside of the adjustment member (7) and a clip (90) is engaged with the restriction groove (72).

8. The switch device for a nail gun as claimed in claim 7, wherein the ring (53) defines the recess (12) into a first area (121) and a second area (122), the air way (120) communicates the first area (121) with the end member (20), the first release path (C) communicates with the first area (121) with the outside of the body (10).

9. The switch device for a nail gun as claimed in claim 8, wherein the seal (9) mounted to the cylinder (30) defines the main chamber (10) into a first chamber (100) and a second chamber (101), the second chamber (101) communicates with the second area (122) via the communication path (B).

* * * * *